US008156849B2

(12) United States Patent
Bunce

(10) Patent No.: US 8,156,849 B2
(45) Date of Patent: Apr. 17, 2012

(54) WORK HEAD

(75) Inventor: Philip Bunce, Portland (AU)

(73) Assignee: Eastland Medical Systems Ltd., West Perth, Western Australia (AU)

( * ) Notice: Subject to any disclaimer, the term of this patent is extended or adjusted under 35 U.S.C. 154(b) by 859 days.

(21) Appl. No.: 11/547,514

(22) PCT Filed: Mar. 24, 2005
(Under 37 CFR 1.47)

(86) PCT No.: PCT/AU2005/000433
§ 371 (c)(1),
(2), (4) Date: Sep. 19, 2008

(87) PCT Pub. No.: WO2005/095018
PCT Pub. Date: Oct. 13, 2005

(65) Prior Publication Data

US 2009/0216363 A1 Aug. 27, 2009

(30) Foreign Application Priority Data

Mar. 31, 2004 (AU) ..... 2004901716
Jan. 7, 2005 (AU) ..... 2005900057

(51) Int. Cl.
*B23B 7/12* (2006.01)
*B23B 13/04* (2006.01)

(52) U.S. Cl. ..... 82/142; 82/165

(58) Field of Classification Search ..... 82/70.1, 82/101, 142, 146, 147, 162, 165; 29/38 B; 483/20
See application file for complete search history.

(56) References Cited

U.S. PATENT DOCUMENTS

| | | | | |
|---|---|---|---|---|
| 755,198 | A | 3/1904 | Webb | |
| 2,140,019 | A * | 12/1938 | Lewis | 29/38 A |
| 2,713,760 | A | 7/1955 | Dunham et al. | |
| 2,876,527 | A * | 3/1959 | Matlachowsky | 29/38 B |
| 2,932,062 | A | 4/1960 | Speakman et al. | |
| 3,336,654 | A | 8/1967 | Ryan | |
| 3,735,652 | A * | 5/1973 | Scharfen | 82/147 |
| 3,762,035 | A * | 10/1973 | Ledergerber et al. | 29/558 |
| 3,981,056 | A * | 9/1976 | Gilbert et al. | 29/38 B |
| 4,216,628 | A | 8/1980 | Wada | |

(Continued)

FOREIGN PATENT DOCUMENTS

DE 28 45 825 4/1979

(Continued)

OTHER PUBLICATIONS

Derwent Abstract Accession No. 92-269053/33, BR 9005255 A (IMT INST MAUA Technologica) Jun. 30, 1992.

*Primary Examiner* — Will Fridie, Jr.
(74) *Attorney, Agent, or Firm* — Merchant & Gould P.C.

(57) ABSTRACT

A work head adapted to support at least one elongate work piece, said work head having a first drive shaft capable of rotation about a central axis, said work pieces being supported from the work head at a position spaced radially from the central axis such that the axis of each work piece is in the same plane as the central axis, the work pieces supported from the work head to be capable of rotation about their central axes, the drive shaft adapted to be caused to rotate by a first drive, the work pieces adapted to be caused to rotate by a second drive.

23 Claims, 6 Drawing Sheets

U.S. PATENT DOCUMENTS

| | | | | |
|---|---|---|---|---|
| 4,563,925 | A * | 1/1986 | Link | 82/142 |
| 5,282,715 | A | 2/1994 | Abbate et al. | |
| 5,400,517 | A | 3/1995 | McKendrick | |
| 6,099,504 | A | 8/2000 | Gross et al. | |
| 7,361,163 | B2 | 4/2008 | Cohen | |
| 2002/0188251 | A1 | 12/2002 | Staylor et al. | |
| 2003/0105430 | A1 | 6/2003 | Lavi et al. | |
| 2003/0130619 | A1 | 7/2003 | Safabash et al. | |

FOREIGN PATENT DOCUMENTS

| | | |
|---|---|---|
| DE | 30 35 657 | 5/1982 |
| DE | 195 04 368 | 4/1996 |
| DE | 199 16 212 | 10/2000 |
| DE | 101 59 068 | 6/2003 |
| EP | 0 591 992 | 4/1994 |
| EP | 0 650 697 | 7/1999 |
| GB | 2 054 435 | 2/1981 |
| JP | 9-29572 | 2/1997 |
| JP | 2003-231032 | 8/2003 |
| WO | WO 97/00702 | 1/1997 |
| WO | WO 98/19723 | 4/1998 |
| WO | WO 00/25845 | 5/2000 |
| WO | WO 02/089680 | 11/2002 |
| WO | WO 03/092771 | 11/2003 |
| WO | WO 2004/065036 | 8/2004 |
| WO | WO 2005/095051 | 10/2005 |

* cited by examiner

WORK HEAD

FIELD OF THE INVENTION

This invention relates to a work head which is able to support one or more work pieces which are required to be shaped by a machining tool. The invention has a particular application to the machining of work pieces in a CNC machining center but is not restricted in its scope to such application.

BACKGROUND

The use of CNC centers is well established in the machining of work pieces in order to efficiently produce machined items of considerable complexity and where the machining requires a number of actions to be applied to the work piece to produce the completed item. Generally such centers comprise a chuck which supports the work piece and is able to cause rotation of the work piece. The chuck is associated with a tool head which is movable into and out of a working relationship with the work piece. The tool head has access to a magazine of tools and is able to extract a tool from the magazine of tools according to the machining required and apply the tool to the work piece whilst the work piece is caused to rotate to achieve the desired configuration of the final product.

DISCLOSURE OF THE INVENTION

Accordingly the invention resides in a work head adapted to support at least one elongate work piece, said work head having a first drive shaft capable of rotation about a central axis, said work pieces being supported from the work head at a position spaced radially from the central axis such that the axis of each work piece is in the same plane as the central axis, the work pieces supported from the work head to be capable of rotation about their central axes, the drive shaft adapted to be caused to rotate by a first drive, the work pieces adapted to be caused to rotate by a second drive.

According to a preferred feature of the invention the axis of each work piece is parallel to the central axis. According to an alternative feature of the invention the axis of each work piece is inclined relative to the central axis.

According to a preferred feature of the invention the first drive shaft is adapted to be connected to a driven shaft which is driven by the first drive. According to one embodiment the work head is removably engageable with the driven shaft.

According to an alternative preferred feature of the invention the first drive shaft comprises a driven shaft which is driven by the first drive. According to a preferred feature of the invention said work head is removably engageable with the drive shaft.

According to an alternative preferred feature of the invention the first drive is accommodated in the work head. According to a preferred feature of the invention the first drive comprises a first electric motor between the first drive shaft and a first stator which is stationary.

According to a preferred feature of the invention the work head comprises a second drive shaft which is concentric with the first drive shaft, wherein the second drive shaft is driven by the second drive to rotate about the central axis and wherein rotation of the one drive shaft relative to the other drive shaft causes said rotation of the work pieces about their central axes.

According to a preferred feature of the invention the second drive comprises a second electric motor between the second drive shaft and a second stator which is stationary.

According to a preferred feature of the invention the first and second stator comprise a single stator concentric to both drive shafts and located there between.

According to a preferred feature of the invention the second drive shaft surrounds the first drive shaft.

According to a preferred feature of the invention the second drive comprises an electric motor between the first and second drive shaft.

According to a preferred feature of the invention the second drive comprises a motor supported for rotation with the first drive shaft and which is drivingly connected to the second drive shaft to cause said rotation of the work pieces with the first drive shaft at an angular velocity equal to that of the first drive shaft and differing form the angular velocity of the second drive shaft.

According to a preferred feature of the invention each work piece is supported from the work head by support member and each support member is supported from the work head to enable said rotation of the work pieces about their central axes. According to a preferred feature of the invention the support member is drivingly connected to the second shaft. According to a preferred feature of the invention the work head supports a concentric array of support members. According to a preferred feature each support member includes a pinion rotatably supported from a radial extension of the first shaft, said pinion being engaged with the second shaft wherein rotation of the second shaft relative to the first shaft causes said rotation of the support member. According to a preferred feature of the invention the pinion is formed as a gear which is meshingly engaged with a gear provided on the second shaft.

According to a preferred feature of the invention the first drive shaft rotatably supports the support members and is associated with an actuator which is drivingly connected to the support members wherein movement of the actuator causes said rotation of the work pieces.

According to a preferred feature of the invention the support member comprises a jig intended in use to hold a set of work pieces which each comprise an elongate shank, said jig having a body adapted to be mounted to the first drive shaft for rotation of the body about the central axis, the body having an outer portion and an inner portion wherein the portions are capable of angular displacement relative to each other, the portions having opposed faces which are concentric and which define clamping faces which in use are intended to support the shanks of the work pieces such that at least one end of the work piece extends axially beyond the body.

According to a preferred feature of the invention the work pieces have a rod-like or wire-like form.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

Each of the embodiments relates to a work head which can be utilised in association with a CNC center where the work head supports a number of work pieces which are able to be simultaneously and/or sequentially worked by a tool supported from the tool head of the centre. It is a function of each of the embodiments to facilitate the working of a number of work pieces in a single operation in order to increase the throughput of the centre.

Figure 1:
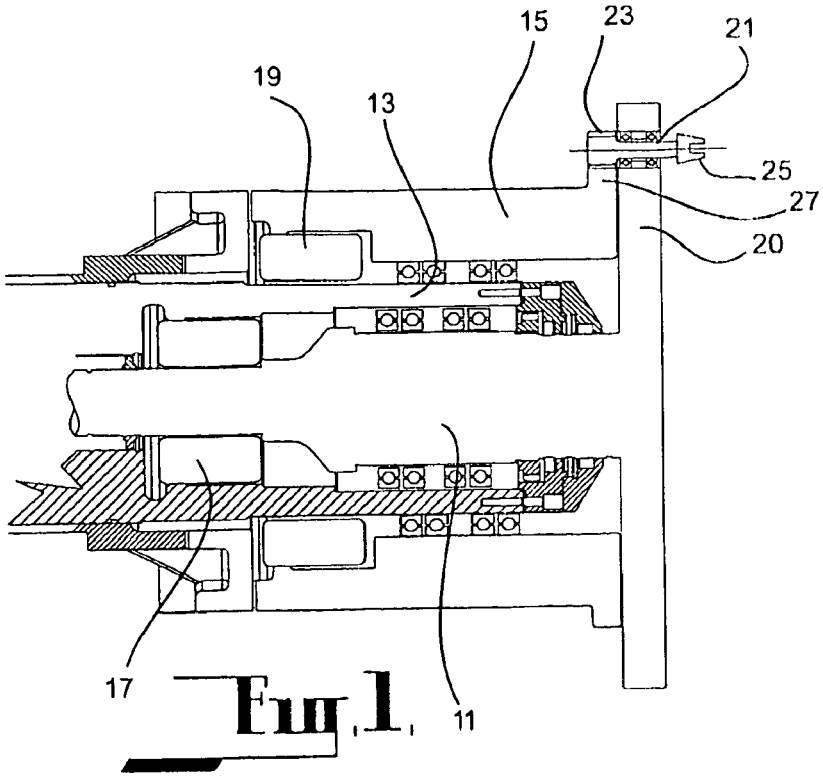
FIG. 1 is a schematic sectional elevation of a work head according to the first embodiment.

The first embodiment of the invention as illustrated at FIG. 1 comprises a pair of concentric shafts 11 and 15 which are supported to either side of a an annular stator 13 which is supported to remain stationary. The innermost shaft 11 is associated with a first drive which is able to cause rotation of the first shaft about a central axis within the stator 13 and the a housing. The second shaft has a tubular configuration and is concentrically received around the stator 13 for rotation about the first shaft 11 and stator 13. In the case of the first embodiment the first drive comprises a first electric motor 17 provided between the first shaft 11 and the stator 13 while the second shaft 15 is driven by a second drive in the form of a second electric motor 19 between the stator 13 and the second shaft 15. The outer end of the first shaft 11 is formed with a radial extension in the form of a disc 19 and the outer portion of the disc 20 supports a circular array of elongate support members 21 which are rotatably supported from the disc 20 to be rotatable about their central axes which are parallel with the central axis of the first shaft. The support members extend to either side of the disc 20. The inner end of each support member 21 is formed as a pinion gear 23 while the outer end of each support member 21 is formed as a chuck element 25. The outer end of the second shaft 15 is in close abutting face to face relationship with the disc 20 and is formed at its outer perimeter with a ring gear 27 which is meshingly engaged with the pinion 23 of the support member.

In the operation of the first embodiment the first and second drive motors 17 and 19 may be driven synchronously such that the first and second shafts 11 and 15 both rotate at the same angular velocity and as a result the support members remain stationary relative to both shafts. In addition the motors can be controlled is such that at periodic intervals the second electric motor 17 may be activated to cause limited relative rotational movement of the second shaft 15 with respect to the first shaft 11. Such relative rotation which will cause rotation of the support members within the disc 20. In addition the motors can be controlled to cause continuous rotation of the support members 25 about their central axes whilst rotating with the first shaft 11 by causing the second shaft 15 to rotate at differing angular velocity from that of the first shaft 11.

In use it is intended that the chuck member of each support member 25 support a work piece. By rotation of both shafts 11 and 15 at a common angular velocity all of the work pieces can be introduced to a tool such as a grinding wheel whereby they can all be ground to provide a facet or like formation. With rotation of the second shaft 15 with respect to the first shaft 11 in a step like manner a separate facet can be formed on all of the work pieces with each relative rotation between the first and second shafts 11 and 15. Alternatively by causing the first and second shaft members 11 and 15 to both rotate but at differing angular velocities each of the work pieces will be caused to rotate continuously about their respective central axis whilst rotating about the central axis of the first drive shaft which can provide for the formation of a compound surface on the work piece.

It is a feature of the first embodiment that a number of work pieces can be machined at the same time and that the nature of the working which can be applied to the work pieces as a result of their orbital motion about the central axis of the drive shaft 11 can take a relatively compound form.

According to an alternative form of the first embodiment the first drive shaft comprises the driven shaft of a CNC machine or lathe or like machine which provides the first drive of the embodiment.

Figure 2:
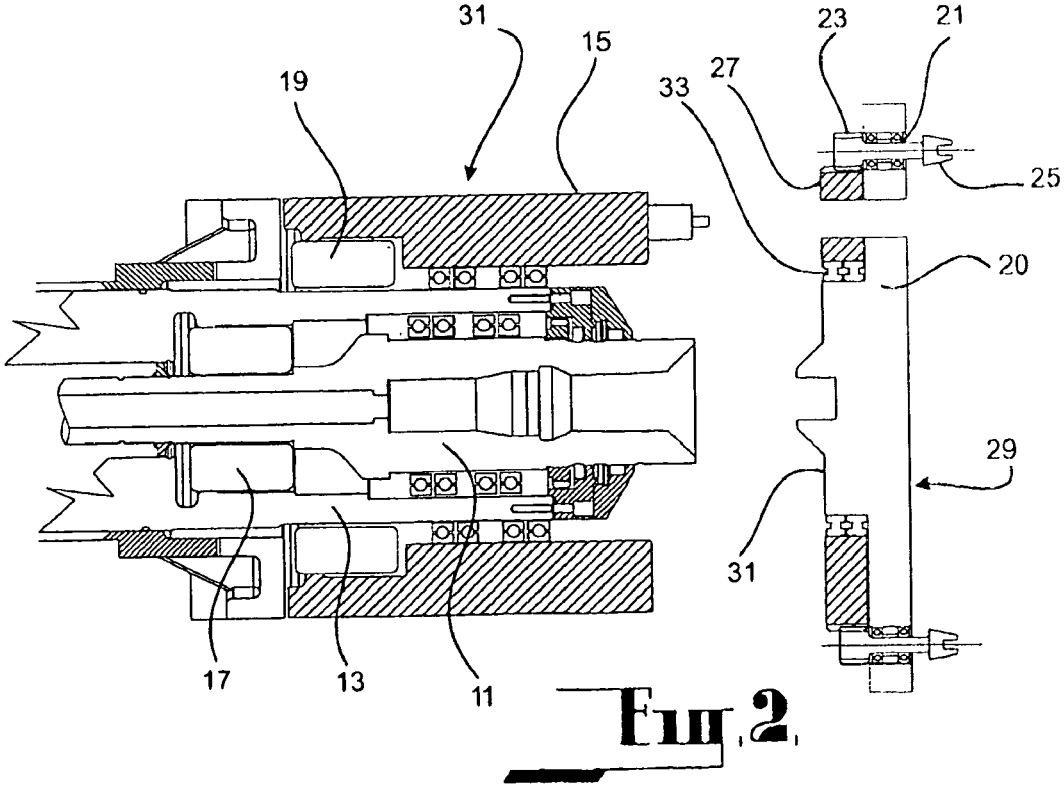
FIG. 2 is a schematic sectional elevation of the second embodiment of the invention.

The work head according to the second embodiment of the invention and as shown at FIG. 2 is a variation of the first embodiment in that the embodiment comprises a jig 29 which is separable from the work head. The jig 29 provides the disc element 20 of the first embodiment. The disc element 20 which is engagable with the outer end of the first drive shaft. The inner axial face of the disc element 20 is formed with a hub 31 which rotatably supports a ring gear 27 through a suitable bearing 33. The ring gear is in turn adapted to be engaged with the outer end of the second shaft 15 to be rotatable therewith. Both the disc member 29 and the ring gear 25 are provided with key ways which will engage with keys supported from the first drive shaft 11 and the second drive shaft 15 respectively whereby the work head may be positively engaged with the work head.

According to an alternative form of the second embodiment the first drive shaft comprises the driven shaft of a CNC machine or lathe or like machine which provides the first drive of the embodiment.

Figure 3:
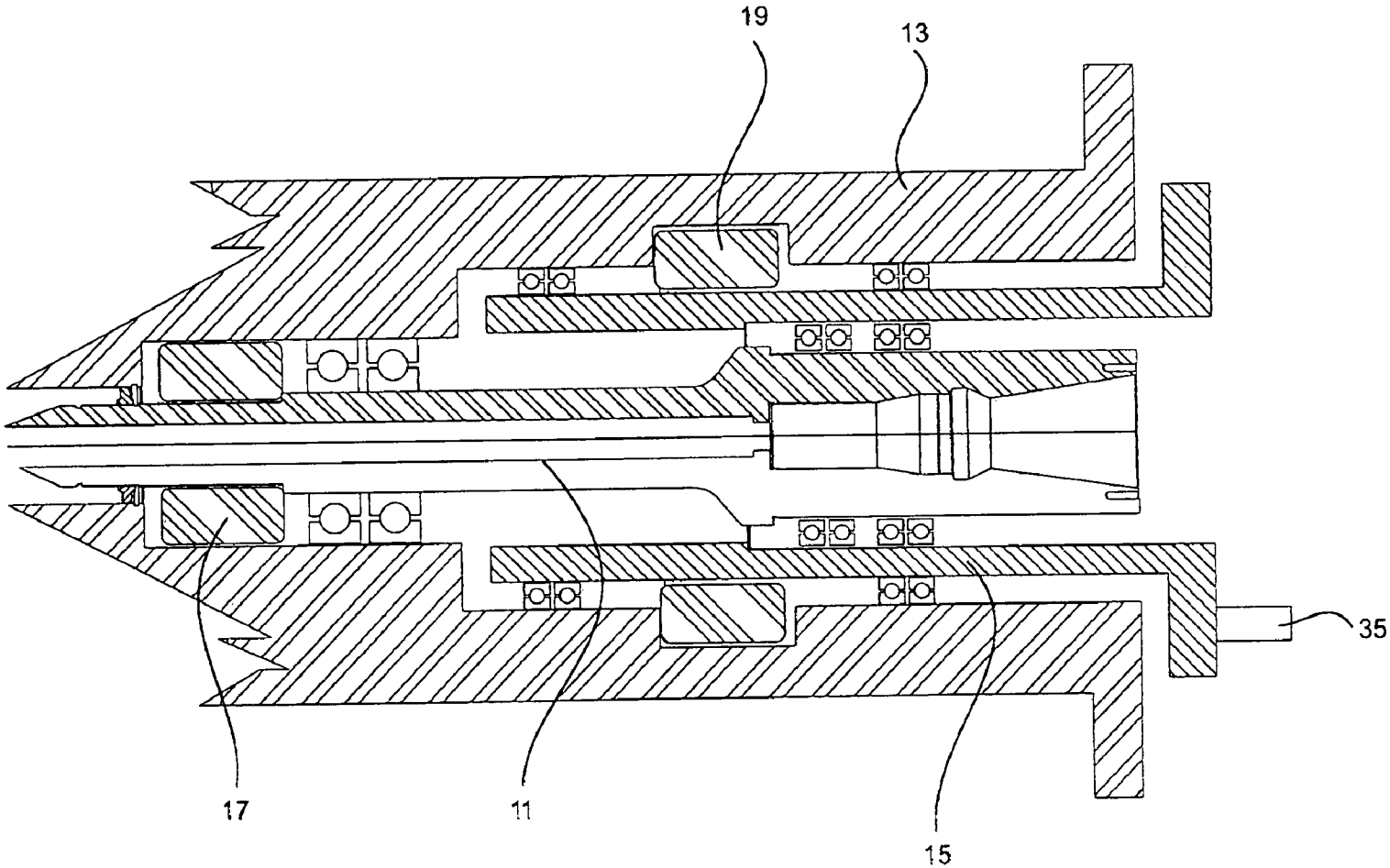
FIG. 3 is a schematic sectional elevation of the work head according to the third embodiment.

The work head according to the third embodiment of the invention and as shown at FIG. 3 comprises a first and second shaft 11 and 13 which are concentrically received over each other through suitable bearings and which are each rotatably supported within a stator 13. The first drive shaft 11 is caused to rotate through a first electric drive motor 17 provided between the stator 13 and the first drive shaft 11 while the second drive shaft 15 is driven from a second electric motor 19 supported between the stator 13 and the second drive shaft 15.

The third embodiment is associated with a rotary jig of the form disclosed as the first embodiment of international patent application PCT/AU2004/000090 and co-pending provisional patent application 2003901713 in the name of the applicant entitled "Jig", the contents of both of which are incorporated into this specification by reference thereto. In this regard the outer end of the second drive shaft supports a set of locating pins 35 (only one is shown) which are receivable in correspondingly located sockets on the outer portion of the jig and outer end of the first shaft is engageable with the inner portion of the jig to retain the jig in position on the work head.

According to an alternative of the third embodiment the first drive shaft comprises the driven shaft of a CNC machine or lathe or like machine which provides the first drive of the embodiment.

Figure 4:
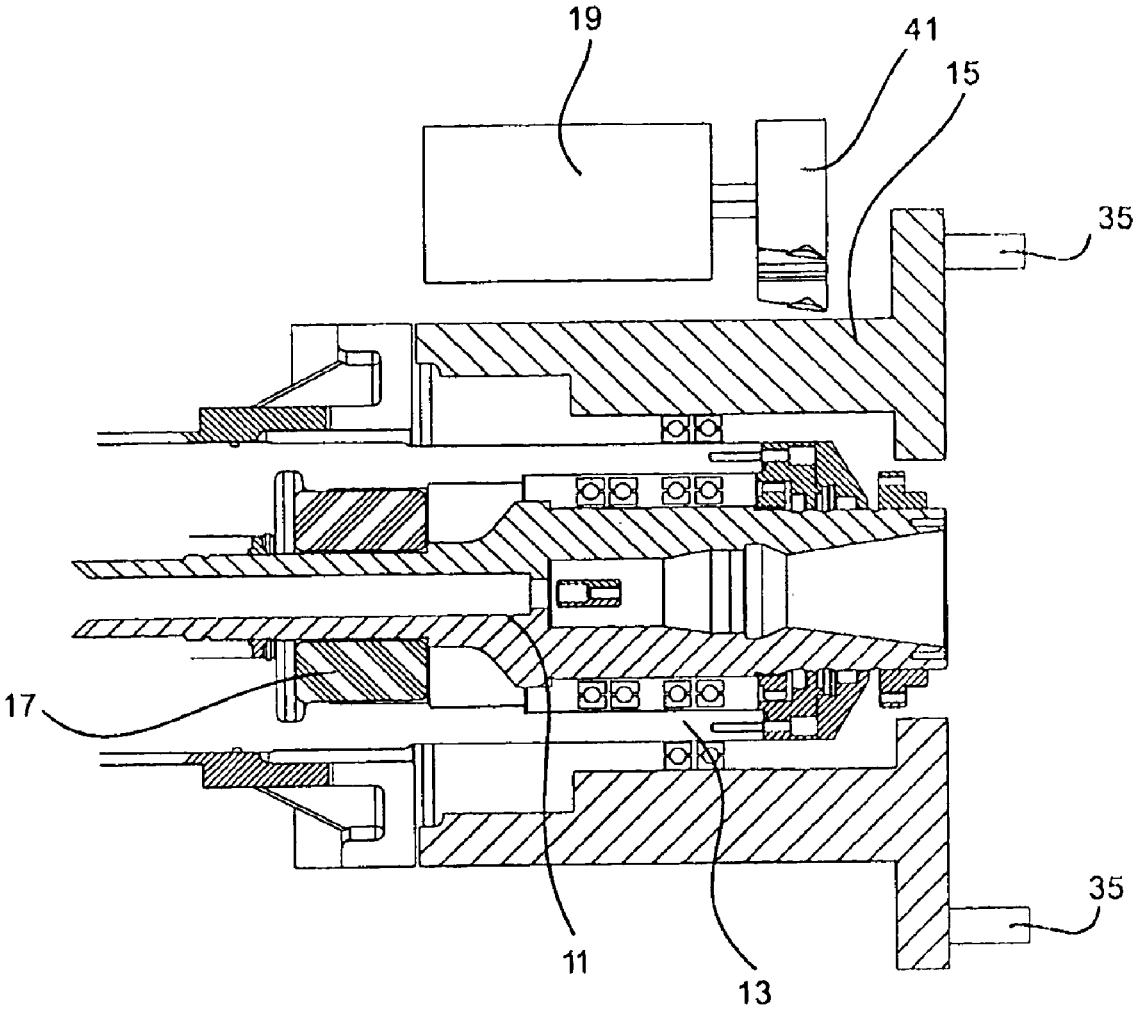
FIG. 4 is a sectional elevation of a work head according to the fourth embodiment.

The work head according to the fourth embodiment of the invention and as shown at FIG. 4 again comprises a first shaft 11 which is rotatably received within a stator 13 and a second drive shaft 15 concentrically received over the stator 13. The drive for the first drive shaft 11 is effected through a first electric motor 17 between the housing 13 and the first drive shaft 11. A second electric motor 19 is supported from the first drive shaft 11 for rotation with the first drive shaft 11. The second electric motor has an output shaft which supports a pulley and a pulley belt 41 is received around the pulley and the second shaft 15. Activation of the second electric motor 19 causes rotation of the second drive shaft 15 around the first shaft as a result of its engagement with the pulley belt 41.

The control for the fourth embodiment is such that the joint rotation of both the first and second drive shafts 11 and 15 is effected primarily by the first electric motor 17 since with the second electric motor 19 inactive the second shaft is retained relative to the first shaft. When it becomes necessary to cause relative rotation between the first drive shaft 11 and the second drive shaft 15, the second drive motor 19 is activated to cause the second shaft caused to rotate relative to the first shaft. Such activation may be in a continuous manner in order to cause continuous relative rotation of the second drive shaft 15 about the first drive shaft 11 or alternatively may be in a step-like manner to cause the step-like rotation of the second shaft 15 about the first shaft 11 as desired.

The fourth embodiment is associated with a rotary jig of the form disclosed as the first embodiment of international patent application PCT/AU2004/000090 and co-pending provisional patent application 2003901713 in the name of the applicant entitled "Jig", the contents of both of which are incorporated into this specification by reference thereto. In this regard the outer end of the second drive shaft supports a set of locating pins 35 (only two are shown) which are receivable in correspondingly located sockets on the outer portion of the jig and outer end of the first shaft is engageable with the inner portion of the jig to retain the jig in position on the work head.

According to an alternative form of the fourth embodiment the second electric motor is supported from a fixed structure such that it is stationary relative to both drive shafts. The control for the second electric motor is such that the angular velocity of the second shaft can be adjusted to from being the same as that of the first drive shaft to being greater than or less than that of the first drive shaft and the differences in velocity can be continuous or periodic.

According to an another alternative form of the fourth embodiment the first drive shaft comprises the driven shaft of a CNC machine or lathe or like machine which provides the first drive of the embodiment.

Figure 5:
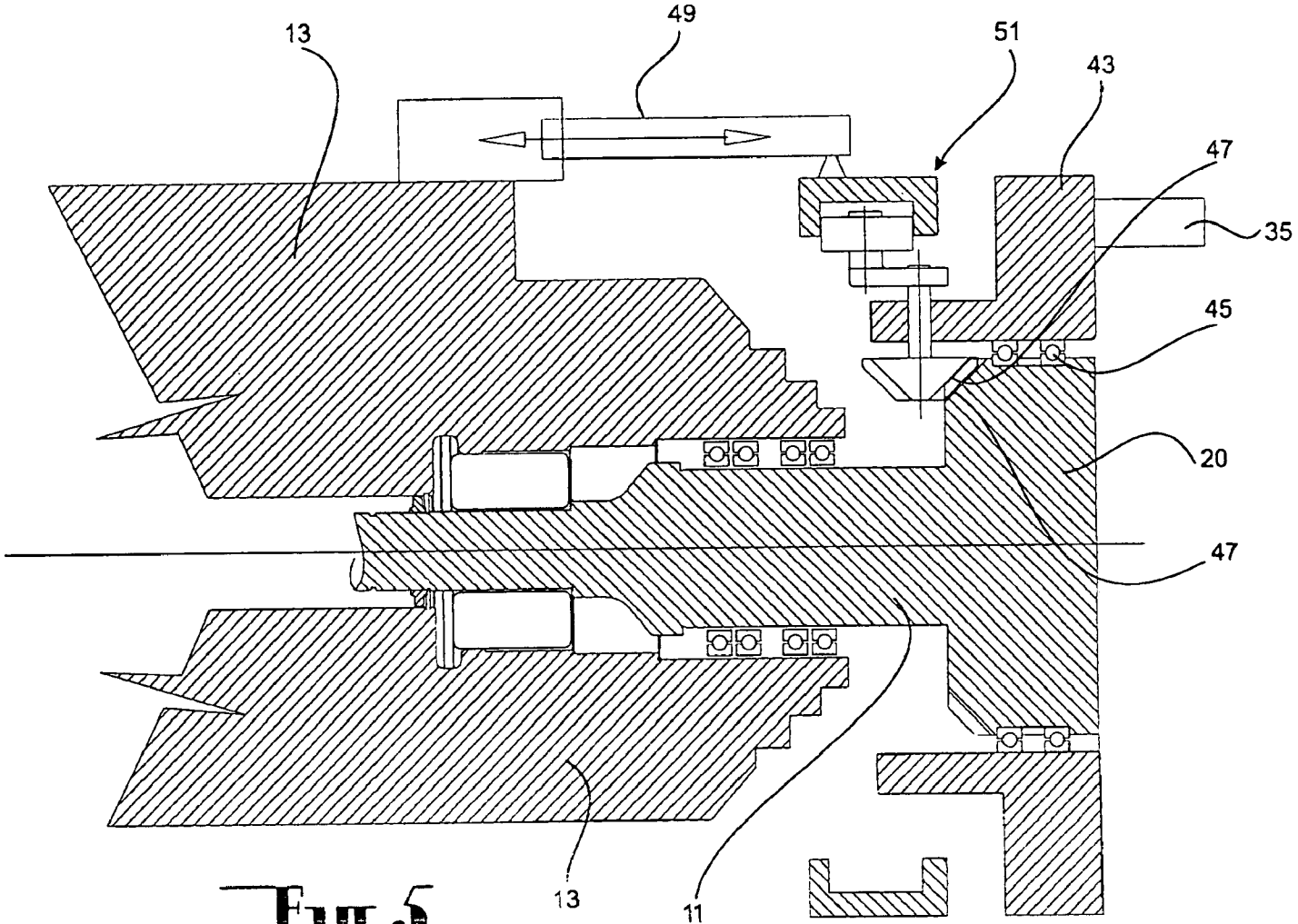
FIG. 5 is a sectional elevation of a work head according to the fifth embodiment.

The work head according to the fifth embodiment of the invention and as shown at FIG. 5 comprises a first drive shaft 11 which is supported from a housing 13 for rotation about a central axis of a drive shaft. The outer end of the drive shaft supports a disc like radial extension 20 which in turn supports an annular ring element 43 through a set of bearings whereby the ring member 43 is capable of rotation on the disc member 20. The inner face of the disc 20 is provided with a bevel ring gear 47 while the ring member 43 supports a pinion gear 49 which is meshingly engaged with the ring gear 47 in order that rotation of the pinion 47 can cause relative rotation between the disc member 20 and the ring member 43. In addition the housing 13 supports a linear actuator 49 which is drivingly connected to the spur gear 47 through a bell crank 51. The effect of the bell crank 51 between the linear actuator 49 and the bevel gear 47 will cause rotation of the bevel gear and consequent rotation of the bevel gear 47 will cause the relative rotation of the ring gear 43 on the disc 20.

The fifth embodiment is associated with a control which is able to control the linear actuator such that the ring gear may be maintained stationary relative to the disc 20 or may be caused to continuously reciprocate on the disc 20 or reciprocate in a step like manner.

The fifth embodiment is associated with a rotary jig of the form disclosed as the first embodiment of international patent application PCT/AU2004/000090 and co-pending provisional patent application 2003901713 in the name of the applicant entitled "Jig", the contents of both of which are incorporated into this specification by reference thereto. In this regard the outer end of the second drive shaft supports a set of locating pins 35 (only one is shown) which are receivable in correspondingly located sockets on the outer portion of the jig and outer end of the first shaft is engageable with the inner portion of the jig to retain the jig in position on the work head.

According to an alternative of the fifth embodiment the first drive shaft comprises the driven shaft of a CNC machine or lathe or like machine which provides the first drive of the embodiment.

Figure 6:
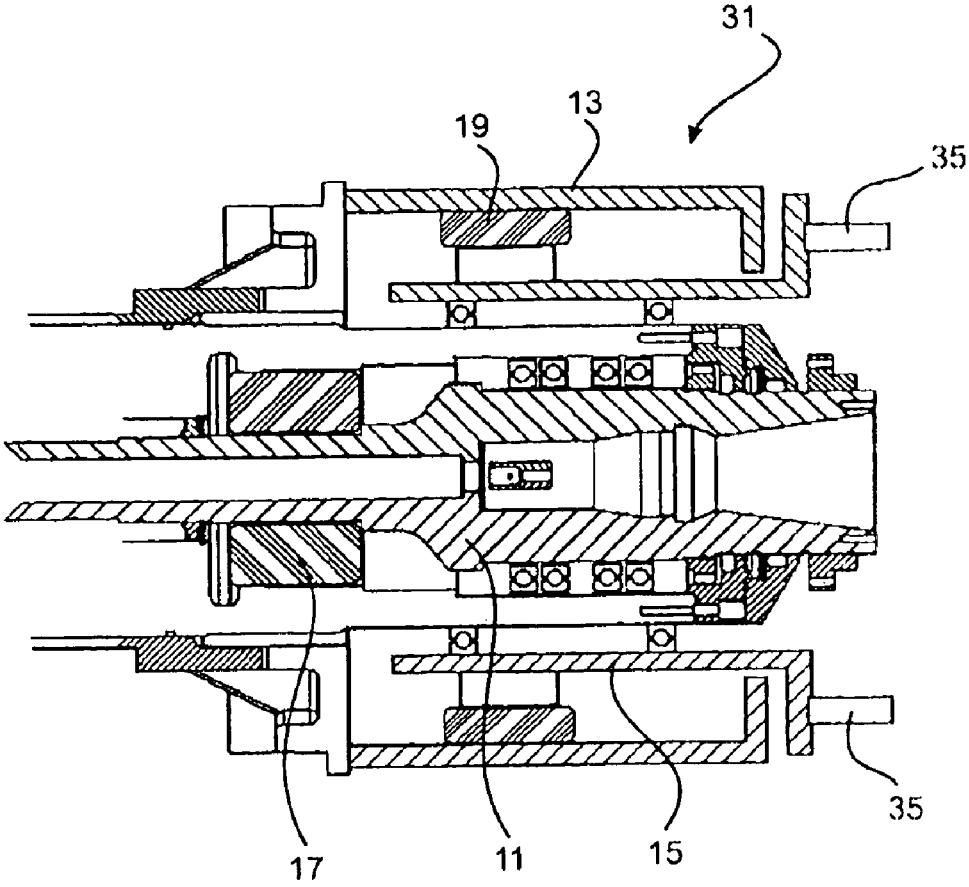
FIG. 6 is a sectional elevation of a work head according to the sixth embodiment.

The work head according to the sixth embodiment of the invention and as shown at FIG. 6 is a variation of the third embodiment of FIG. 3.

The sixth embodiment is associated with a rotary jig of the form disclosed as the first embodiment of international patent application PCT/AU2004/000090 and co-pending provisional patent application 2003901713 in the name of the applicant entitled "Jig", the contents of both of which are incorporated into this specification by reference thereto. In this regard the outer end of the second drive shaft supports a set of locating pins 35 (only two are shown) which are receivable in correspondingly located sockets on the outer portion of the jig and outer end of the first shaft is engageable with the inner portion of the jig to retain the jig in position on the work head.

According to an alternative form of the sixth embodiment the first drive shaft comprises the driven shaft of a CNC machine or lathe or like machine which provides the first drive of the embodiment.

Figure 7:
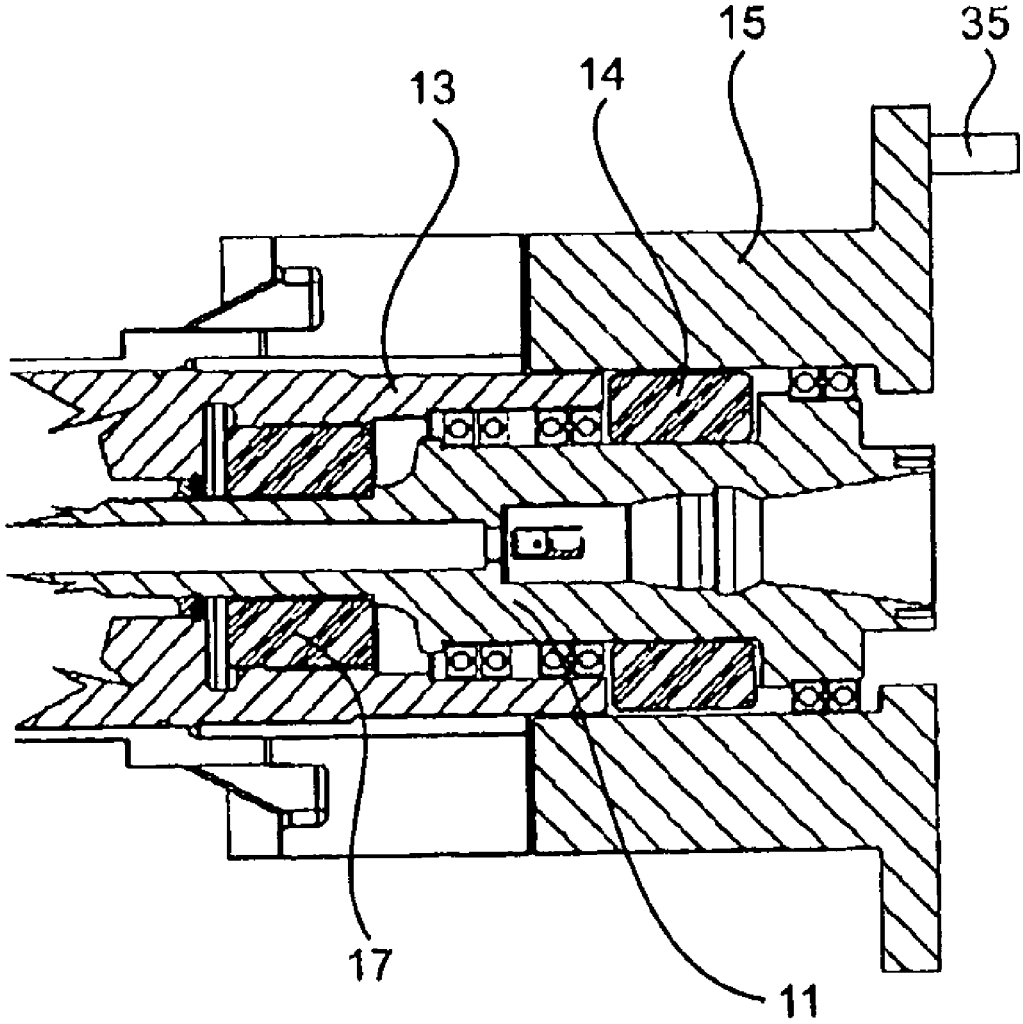
FIG. 7 is a sectional elevation of a work head according to the seventh embodiment.

The work head according to the seventh embodiment of the invention and as shown at FIG. 7 comprises a first and second shaft 11 and 13 which are concentrically received over each other through suitable bearings and with a stator between them which supports the drive shafts through suitable bearings. However the stator only extends for a portion of the overlapping extent of the drive shafts. The first drive shaft 11 is caused to rotate through a first electric drive motor 17 provided between the stator 13 and the first drive shaft 11 while the second drive shaft 15 is driven from a second electric motor 19 supported between the outer portions of the first and second drive shafts 11 and 13.

The seventh embodiment is associated with a rotary jig of the form disclosed as the first embodiment of international patent application PCT/AU2004/000090 and co-pending provisional patent application 2003901713 in the name of the applicant entitled "Jig", the contents of both of which are incorporated into this specification by reference thereto. In this regard the outer end of the second drive shaft supports a set of locating pins 35 (only one is shown) which are receivable in correspondingly located sockets on the outer portion of the jig and outer end of the first shaft is engageable with the inner portion of the jig to retain the jig in position on the work head.

According to an alternative of the seventh embodiment the first drive shaft comprises the driven shaft of a CNC machine or lathe or like machine which provides the first drive of the embodiment.

According to further embodiments of the invention the axes of rotation of the each of the work pieces are in the same plane as the central axis of the first shaft, and are inclined to the central axis of the first shaft Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A work head adapted to support at least one elongate work piece, said work head comprising: a first drive shaft capable of rotation about a central axis, said work pieces being supported from the work head at a position spaced radially from the central axis such that the axis of each work piece is in the same plane as the central axis, the work pieces supported from the work head to be capable of rotation about their central axes, the drive shaft adapted to be caused to rotate by a first drive, the work pieces adapted to be caused to rotate by a second drive.

2. A work head as claimed at claim 1 wherein the axis of each work piece is parallel to the central axis.

3. A work head as claimed at claim 1 wherein the axis of each work piece is inclined relative to the central axis.

4. A work head as claimed at claim 1 wherein the first drive shaft is adapted to be connected to a driven shaft which is driven by the first drive.

5. A work head as claimed at claim 4 wherein the work head is removably engageable with the driven shaft.

6. A work head as claimed at claim 1 wherein the first drive shaft comprises a driven shaft which is driven by the first drive.

7. A work head as claimed at claim 6 wherein said work head is removably engageable with the first drive shaft.

8. A work head as claimed at claim 4 wherein the first drive is accommodated in the work head.

9. A work head as claimed at claim 1 wherein the first drive comprises a first electric motor between the first drive shaft and a first stator which is stationary.

10. A work head as claimed at claim 1 further comprising a second drive shaft which is concentric with the first drive shaft, wherein the second drive shaft is driven by the second drive to rotate about the central axis and wherein rotation of the one drive shaft relative to the other drive shaft causes said rotation of the work pieces about their central axes.

11. A work head as claimed at claim 1 wherein the second drive comprises a second electric motor between the second drive shaft and a second stator which is stationary.

12. A work head as claimed at claim 11 wherein the first and second stator comprise a single stator concentric to both drive shafts and located there between.

13. A work head as claimed at claim 10 wherein the second drive shaft surrounds the first drive shaft.

14. A work head as claimed at claim 10 wherein the second drive comprises an electric motor between the first and second drive shaft.

15. A work head as claimed at claim 1 wherein the second drive comprises a motor supported for rotation with the first drive shaft and which is drivingly connected to the second drive shaft to cause said rotation of the work pieces with the first drive shaft at an angular velocity equal to that of the first drive shaft and differing from the angular velocity of the second drive shaft.

16. A work head as claimed at claim 1 wherein each work piece is supported from the work head by a support member and each support member is supported from the work head to enable said rotation of the work pieces about their central axes.

17. A work head as claimed at claim 16 wherein the work head supports a concentric array of support members.

18. A work head as claimed at claim claim 10, wherein each work piece is supported from the work head by a support member and each support member is supported from the work head to enable said rotation of the work pieces about their central axes, and wherein the support member is drivingly connected to the second shaft.

19. A work head as claimed at claim 16 wherein each support member includes a pinion rotatably supported from a radial extension of the first drive shaft, said pinion being engaged with the second drive shaft wherein rotation of the second drive shaft relative to the first drive shaft causes said rotation of the support member.

20. A work head as claimed at claim 19 wherein the pinion is formed as a gear which is meshingly engaged with a gear provided on the second drive shaft.

21. A work head as claimed at claim 16 wherein the first drive shaft rotatably supports the support members and is associated with an actuator which is drivingly connected to the support members wherein movement of the actuator causes said rotation of the work pieces.

22. A work head as claimed at claim 16 wherein the support member comprises a jig intended in use to hold a set of work pieces which each comprise an elongate shank, said jig having a body adapted to be mounted to the first drive shaft for rotation of the body about the central axis, the body having an outer portion and an inner portion wherein the portions are capable of angular displacement relative to each other, the portions having opposed faces which are concentric and which define clamping faces which in use are intended to support the shanks of the work pieces such that at least one end of the work piece extends axially beyond the body.

23. A work head as claimed at claim 1 wherein the work pieces have a rod-like or wire-like form.

* * * * *